United States Patent [19]

Lauga

[11] Patent Number: 4,474,164

[45] Date of Patent: Oct. 2, 1984

[54] SAWING MACHINE FOR STONE BLOCKS

[75] Inventor: Gilles J. Lauga, Fauvillers, Belgium

[73] Assignee: Norton Company, Worcester, Mass.

[21] Appl. No.: 388,050

[22] Filed: Jun. 14, 1982

[30] Foreign Application Priority Data

Jun. 19, 1981 [FR] France ..... 81 12132

[51] Int. Cl.[3] ..... B28D 1/06

[52] U.S. Cl. ..... 125/16 R; 125/19

[58] Field of Search ..... 125/16 R, 16 L, 16, 125/17, 18, 19

[56] References Cited

U.S. PATENT DOCUMENTS

| | | | |
|---|---|---|---|
| 1,538,512 | 5/1925 | Canning | 125/16 R |
| 2,951,475 | 9/1960 | Leo | 125/16 R |
| 3,760,789 | 9/1973 | Egleme | 125/18 |

*Primary Examiner*—Harold D. Whitehead
*Attorney, Agent, or Firm*—Walter Fred

[57] ABSTRACT

Machine for stone blocks' sawing.

The sawing machine includes a frame mounted in order to pivot around a horizontal axis (6) and wearing two saw blades (8) on each side of this frame, the cutting edge of the blades (8) having an arc shape which center coincides with this horizontal axis (6).

Means are provided to animate the frame with an oscillating movement around this horizontal axis (6) and to have a forward movement horizontally of the stone blocks (23) in direction of the saw blades (8).

The machine is used for cutting particularly hard stone blocks in slabs (FIG. 1).

7 Claims, 4 Drawing Figures

SAWING MACHINE FOR STONE BLOCKS

BACKGROUND OF THE INVENTION

The purpose of the invention is to saw particularly hard stones with two parallel blades tensioned in a frame having an almost vertical oscillating motion.

For hard stone sawing like granites, one commonly uses sawing machines with one or more blades, animated by a straight reciprocal or oscillating movement. The blades used are either steel ones, sprinkled with water and abrasive grits (like sand, steel shot or silicon carbide) either ones with diamond segments.

Some of those machines only have one blade animated by a horizontal axis oscillation while the stone blocks are in horizontal traverse movement. The blade is tensioned in a frame to avoid deviations during the sawing. It is better to place the blade laterally in order to accomodate blocks of unlimited width.

The major inconvenience of such machines is that one has to cut one slab at a time, rendering the sawing slow and expensive. Another inconvenience is given by the asymmetrical disposition of the blade in tne frame, introducing a bad equilibrium of the tensions in the machine and this creates deviations during the sawing.

Machines having several blades are also well known. Those blades are tensioned parallely in a frame which is animated by a horizontal axis oscillation or a straight reciprocal vertical movement, with a horizontal traverse movement for the block to be sawn. The distance between the blades is chosen in order to saw the slabs with a desired thickness. The evident advantage of such machine is that series of slabs can be sawn in one operation.

The inconveniences of such machine are unfortunately numerous. The tensioning of the blades in the frame is, indeed, a long and arduous operation and it is not possible to modify the distance between the blades as one would like. The width of the sawn slabs can not be regulated in accordance with clients' demands and one has to be satisfied with standard width.

Another inconvenience of multiblade machines lies in the frame wherein the block to be sawn has to pass through. One can thus see that the frame dimensions are determined for those of the blocks. In particular, the width of the blocks has always to be below the inside width of the frame.

It must also be observed that the construction of such kind of multiblade machine is sophisticated and always expensive.

The object of the hereby invention is to remedy the above mentioned inconveniences, realizing a double blade sawing machine, giving the opportunity of simultaneous sawing of two slabs with arbitrary thickness in two independent blocks placed on both sides of the machine. One realizes like this a symmetrical machine, fast and economical.

SUMMARY OF THE INVENTION

The purpose of the invention is to produce a sawing machine having an oscillating frame with two blades and the possibility of a horizontal forward movement of the blocks.

The frame, which has an oscillating motion around a horizontal axis, is symetrical with regard to a vertical plane being perpendicular to the metioned axis.

The frame is able to wear two blades placed in two planes, being perpendicular to the horizontal axis of pivot, on both sides of the mentioned frame.

The cutting edge of the saw blades has an arc shape whose center coincides with the horizontal axis of pivot.

Each end of the blades is fixed on the frame with hangers, overhanging on each side of the frame. Those hangers are equipped with means and suited to fix the extremities of the blades and to tension them.

The sawing machine also has means to animate the frame with an oscillating movement through the horizontal axis, so that the longitudinal axis of the blades forms always an acute angle with the vertical.

On both sides of the machine, transport means are provided in order to move the blocks horizontally and parallely to the blades' plane, in direction of them. Means for the regulation of the two blocks' position on those transport means in regard to the two blades' plane are also provided.

Following a particular executing form of the invention, the frame has a straight prism form with triangular basis, made of metallic beams disposed in the direction of the prism's "arete", perpendicularly to the triangular basis, and the longitudinal axis of each of the two blades is in the plane obtained by the face of the prism opposed to the horizontal axis of pivot.

Following a favorable form of the invention, a guiding apparatus of the frame is provided in the vicinity of the blades, to avoid all lateral deviations of those blades.

Following a preferred execution form of the invention, the guiding apparatus is made of plates fixed parallel to the blades' plane against a concrete mass placed between the blades and the frame is equipped with rollers placed on both sides of the concrete mass in order to roll without play on the metallic plates.

Following a favorable form of the invention, the means able to animate the frame with an oscillating motion around the horizontal axis of pivot are constitued by a rod-crank system dragged by an electrical motor by means of a speed reducer system.

Following a favorable form of the invention, the cutting edge of the blades comprises diamond segments and one can favorably provide for the opposite edge a concave shape, in order to distribute the tensions in the blade.

In conformity with the invention, the means permitting the fixation of the blades' ends to the frame are provided for applying to them tensions following the oblique directions in regard of the horizontal axis of those blades, in order to give the blade an internal tension perpendicular to the cutting edge of the blades.

Following a particular form of execution, those means permitting the application to each blade oblique tensions in regard of the longitudinal asis of this blade are constituted by screws and adjustable nuts system which axis are situated in this blade plane forming with the longitudinal axis of the blade an acute angle to the outside.

Following a favorable form of the invention, those transport means able to lead the stone blocks to the sawing blades are constituted by two chariots placed on each side of the machine on horizontal rails parallel to the blade's plane, each chariot's speed of movement can be adjusted.

The positioning regulation means of the blocks on the transport means are well known and can favorably be constituted by two jacks solidary to those transport means and by two measure keys.

Other characteristics and advantages of the invention will be brought out from the description given as a non-restrictive example of a particular realization form of the invention, referring to the annexed drawings, wherein:

BRIEF DESCRIPTION OF THE DRAWINGS

On all those figures, analogous or identical elements are designed by the same reference numbers.

DESCRIPTION OF THE PREFERRED EMBODIMENT

Figure 1:
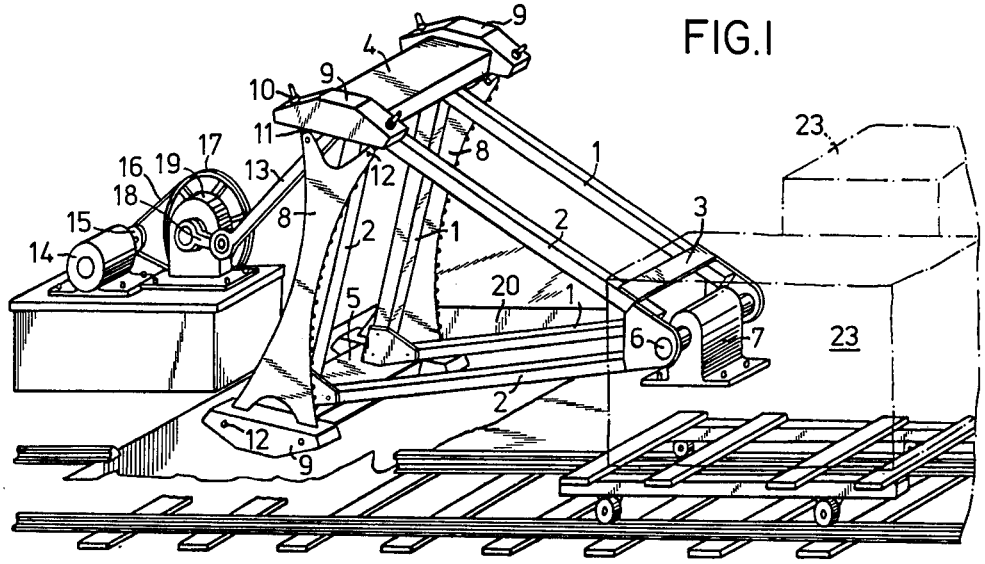
FIG. 1 is a perspective of a sawing machine following the invention.

The sawing machine's frame shown on FIG. 1 has a straight prism with triangular basis, constituted by metallic beams 1 to 5 disposed following the prism's "aretes" and assembled by well known means. A horizontal axis of pivot 6 solidary to a pillow block 7 and situated following a prism's "arrete" perpendicular to the triangular basis of this prism permits the pivotting of the frame.

The prism's face opposed to the horizontal axis 6 is provided to wear two saw blades 8, biconcave and with diamond segments, situated in two planes perpendicular to this horizontal axis of pivot 6 on each side of the frame. Each cutting edge of the blades 8 has an arc shape whose center coincides with the horizontal axis of pivot 6.

Each end of the saw blades 8 is fixed in fixation pieces 9 solidary to the extermities of the two horizontal cross-members 4 and 5, forming the prism's "arretes" opposed and parallel to the horizontal axis of pivot 6; the fixation pieces 9 are themselves disposed over-hanging on each side of the frame.

A screw and adjustable nut system 10 mounted on the fixation pieces 9 permits the tensioning of the blades 8, by the means of joining means 11, gudgeons 12, the longitudinal axises of the fixation screws 10 of each blade 8 situating in this blade's plane, forming with the longitudinal axis of the blade 8 a certain angle to the outside.

The superior horizontal cross-member is equipped with an anchoring means wherein the superior extremity of the rod 13 forming a part of an alternative dragging system (including electrical motor 14 equipped with a pinion 15, a driving belt 16, a fly-wheel 17, a crank 18, and a bearing 19) is fixed, the inferior extremity of the rod 13 is fixed in the extremity of the crank 18, in order to permit the alternative dragging system to animate the machine's frame by an oscillating motion turning around the horizontal axis of pivot 6.

The disposition of the bearings 7 and 19, of the crank 18 and the rod 13 is so that the longitudinal axis of the blades 8 always stays inclined in regard of the vertical in the opposite direction to the forward movement. The bearing 7 is placed in order to have the horizontal axis of pivot 6 slightly above the ground level, and a pit 20 is provided in the ground between the bearing 7 and the alternative dragging system, in order to permit the free oscillation of the frame's inferior beams and the inferior horizontal cross-member 5.

On both sides of the machine, one has provided transport means constituted by two horizontal railways 21, parallel to the saw's plane 8 and by two chariots 22, each one able to wear a stone block 23.

Figure 2:
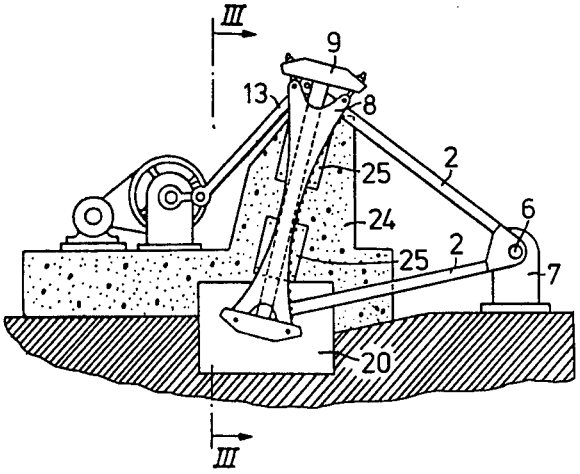
FIG. 2 is a schematic elevation view of the sawing including a guiding apparatus.

The sawing machine represented on FIG. 2 includes a guiding apparatus in order to avoid any horizontal movement of the frame. A concrete mass 24 is placed between the metallic beams 1 and 2 of the machine, and wear two metallic plates 25 on each of its lateral faces. The concrete mass is placed as a bridge across the pit 20 in order to save a sufficient space for the inferior horizontal cross-member 5.

Figure 4:
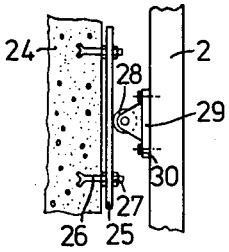
FIG. 4 shows a construction's detail of the guiding apparatus as represented in FIG. 3.
Figure 3:
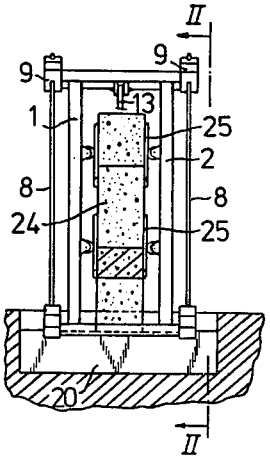
FIG. 3 is a vertical section (following line III—III of FIG. 2) of the sawing machine shown in FIG. 2.

As shown on FIG. 3 and FIG. 4, the rollers 28 are fixed on the vertical beams 1 and 2 by the means of the supports 29 bolted on those vertical beams. A horizontal regulation system of the metallic plates 25, constituted by nuts 27 adjustable on the drawn gudgeons 26, permits to render void the horizontal play between the metallic plates 25 and the rollers 28.

One of the important advantages given by the invention lies in the fact that it unites simplicity and operation's easiness of one-blade machines with symmetry and tensions' balancing of the multi-blade machines.

The machine according to the invention is able to saw simultaneously two difference blocks, of different dimensions, following slabs of arbitrary thickness.

Another advantage of the invention is that it is able to modify very easily the thickness of the cutting slabs by a simple regulation of the blocks' position on the transport means. With such simplicity of the regulation's operation of the slab's thickness, one can saw economically slabs of any thickness.

The blades' disposition on each side of the frame gives the opportunity of theoretically unlimited thickness for blocks' sawing because this thickness will depend on the transport means and not on the blades' spacing.

Of course, the invention is not limited to the execution forms that have been described and represented as a non-limitative example, and many modifications can be brought without going out of its limits.

I claim:

1. A machine for sawing blocks of stone comprising:

support means including a pivot bearing with a horizontal pivot axis fixed a predetermined distance above ground level and centrally on a forward end portion of the support means;

a triangular straight prism shape frame with a pivot adjacent a forward center apex of the triangular frame connected to the pivot bearing block and mounted to oscillate arcuately about the horizontal pivot axis and in a vertical plane perpendicular to the horizontal pivot axis and the frame having spaced triangular shape side members extending parallel and symmetrical to the vertical plane each including upper and lower oppositely inclined beams connected together at and extending rearwardly from the forward center apex to opposite ends thereof adjacent upper and lower rear apexes of the triangular side member, a forwardly inclined rear beam extending between and fixed to the opposite ends of the upper and lower oppositely inclined beams adjacent the rear apexes of the triangular side member, upper and lower cross members extending horizontally across and fixed to the upper and lower beams and including upper and lower overhanging end portions extending beyond opposite sides of the frame adjacent the upper and lower rear apexes thereof;

a pair of saw blades each having a longitudinal axis adjacent an arc shape cutting edge whose center coincides with the horizontal pivot axis, and opposite extremeties of each blade fixed to the upper and lower overhanging end portions of the upper and lower cross members and between which each blade is tensioned and disposed longitudinally parallel to the vertical plane and spaced outwardly from the adjacent side member of the frame;

fixation means for fixing the extremities of the saw blades to the upper and lower overhanging end portions and tensioning the saw blades therebetween;

oscillating means, including a rod having one end pivotally connected to the upper crossmember of the triangular frame and its opposite end pivotally connected to a rotatable crank and able to oscilate the frame and saw blades arcuately about the horizontal axis and maintain the longitudinal axis of the saw blades forwardly inclined at an acute angle to a vertical;

transport means situated on each side of the frame for supporting and transporting blocks of stone horizontally toward and parallel to the oscillating saw blades and cutting a slab therefrom; and guide means, extending upwardly and centrally from the support means and situated in between the upper and lower horizontal cross members and the forwardly inclined rear beams of the spaced triangular shape opposite side members of the frame, for supporting and preventing any lateral deviation of the oscillating frame and saw blades relative to the vertical plane.

2. A machine for sawing blocks of stone according to claim 1 wherein the guide means comprises:

an upper central guide portion of the support means extending upwardly and forwardly into space between the forwardly inclined rear beams and the upper and lower horizontal cross member of the frame, a side-plate fixed to each side of the upper guide portion with the outer surfaces of the plates situated parallel to the cutting plane of saw blades, and roller means fixed to and extending from each of the forwardly inclined rear beams into rolling guiding engagement with the side plates.

3. A machine for sawing blocks of stone according to claim 2 wherein the oscilating means comprises:

a rod-crank drive system including a speed reducer connected to rotate the crank connected to the rod and a rotatable drive motor connected to rotate the speed reducer and crank and all being mounted on a lower rear central portion of the support means situated rearwardly of the upwardly extending upper central guide portion and within planes of the opposite sides of the frame without interference with the transport of the blocks of stone.

4. A machine for sawing blocks of stone according to claim 3 wherein the arc shape cutting edge of each saw blade comprises:

diamond segments fixed to an adjoining concave edge extending between the extremities of the saw blade.

5. A machine for sawing blocks of stone according to claim 4 wherein each saw blade further comprises:

a concave back edge opposite the arc shape cutting edge both extending arcuately between wider extremities of the saw blade.

6. A machine for sawing blocks of stone according to claim 5 wherein the fixation means comprises:

lower fixation pieces fixed to the lower overhanging end portions of the lower horizontal cross member and adapted to receive the lower extremity of each saw blade and gudgeons extending through the fixation pieces and lower oblique portions of lower extremities of the saw blade adjacent each concave surface for joining the saw blade thereto, upper fixation pieces fixed to the upper overhanging portions of the upper horizontal cross member and a screw and adjustable nut system extending through each side of the upper fixation pieces at an acute angle to the longitudinal axis of the blade and joining upper oblique side portions of upper extremeties of the saw blades adjacent each concave surface to the upper fixation pieces and tensioning the saw blade obliquely to the longitudinal axis thereof and thereby create in each saw blade an internal tension perpendicular to the arc shape cutting edge.

7. A machine for sawing blocks of stone according to claim 6 wherein the transport means comprises:

horizontal rails extending parallel to the cutting plane of the saw blade on each side of the frame, two chariots each movable on the horizontal rails on each side of the frame for supporting and moving the blocks of stone into the oscillating saw blades at a predetermined adjustable forward speed.

* * * * *